US010012054B2

(12) United States Patent
Ciglenec et al.

(10) Patent No.: US 10,012,054 B2
(45) Date of Patent: Jul. 3, 2018

(54) DOWNHOLE LOGGING TOOL COOLING DEVICE

(71) Applicant: VisuRay Technology Ltd., Sliema (MT)

(72) Inventors: Reinhart Ciglenec, Katy, TX (US); Max Spencer, Stavanger (NO); Dominik Szlezak, Stavanger (NO); Ådne Voll, Stavanger (NO)

(73) Assignee: VISURAY TECHNOLOGY LTD. (MT)

( * ) Notice: Subject to any disclaimer, the term of this patent is extended or adjusted under 35 U.S.C. 154(b) by 130 days.

(21) Appl. No.: 14/377,250

(22) PCT Filed: Feb. 7, 2013

(86) PCT No.: PCT/NO2013/050022

§ 371 (c)(1),
(2) Date: Aug. 7, 2014

(87) PCT Pub. No.: WO2013/119125

PCT Pub. Date: Aug. 15, 2013

(65) Prior Publication Data

US 2015/0345254 A1 Dec. 3, 2015

(30) Foreign Application Priority Data

Feb. 8, 2012 (NO) ..... 20120129
Jan. 31, 2013 (NO) ..... 20130156

(51) Int. Cl.
*E21B 36/00* (2006.01)
*E21B 47/06* (2012.01)
*E21B 47/01* (2012.01)

(52) U.S. Cl.
CPC ..... *E21B 36/001* (2013.01); *E21B 47/011* (2013.01); *E21B 47/065* (2013.01)

(58) Field of Classification Search
CPC ..... E21B 47/011; E21B 36/001
See application file for complete search history.

(56) References Cited

U.S. PATENT DOCUMENTS 3,265,893 A * 8/1966 Rabson ..... E21B 36/003 165/902
4,340,405 A * 7/1982 Steyert, Jr. ..... F25D 3/00 165/185

(Continued)

FOREIGN PATENT DOCUMENTS

CA 2 377 424 A1 9/2003

OTHER PUBLICATIONS

International Search Report dated May 8, 2013 in corresponding PCT International Application No. PCT/NO2013/050022.

(Continued)

*Primary Examiner* — Kipp C Wallace
(74) *Attorney, Agent, or Firm* — Ostrolenk Faber LLP

(57) ABSTRACT

A downhole tool cooling device (2) is described, wherein a downhole tool (1) is thermally coupled to a rechargeable cold source (21) comprising a solid cold source body (211) being contained in an insulated cooling medium vessel (22), and wherein the downhole tool (1) is thermally coupled to the cold source (21) by means of a cooling circuit (23) comprising a first heat exchanger (11) arranged at the downhole tool (1) and in a fluid communicating manner being interconnected with a second heat exchanger (231) arranged in the solid cold source body (211), wherein a refrigeration system (5) is thermally coupled to the cold source (21) during a downhole operation of the cooling device (2). Furthermore is described a method for cooling a downhole tool (1). Also is described use of a pre-cooled solid cold source body (211) contained in an insulated cooling medium vessel (22) as a cold source (21) for a (Continued)

cooling circuit (23) being thermally coupled to a downhole tool (1) being in the need of cooling during downhole operations.

14 Claims, 1 Drawing Sheet

(56) References Cited

U.S. PATENT DOCUMENTS

| | | | | |
|---|---|---|---|---|
| 4,375,157 | A | 3/1983 | Boesen | 62/260 |
| 2004/0264543 | A1 | 12/2004 | Storm et al. | 374/141 |
| 2005/0097911 | A1 | 5/2005 | Revellat et al. | 62/259.2 |
| 2006/0102353 | A1* | 5/2006 | Storm | E21B 47/011 166/302 |
| 2006/0144619 | A1* | 7/2006 | Storm, Jr. | E21B 47/011 175/17 |
| 2006/0191682 | A1* | 8/2006 | Storm | E21B 47/011 166/250.01 |
| 2008/0066534 | A1* | 3/2008 | Reid | E21B 49/06 73/152.11 |
| 2008/0223579 | A1 | 9/2008 | Goodwin | |

OTHER PUBLICATIONS

Written Opinion dated May 8, 2013 in corresponding PCT International Application No. PCT/NO2013/050022.

* cited by examiner

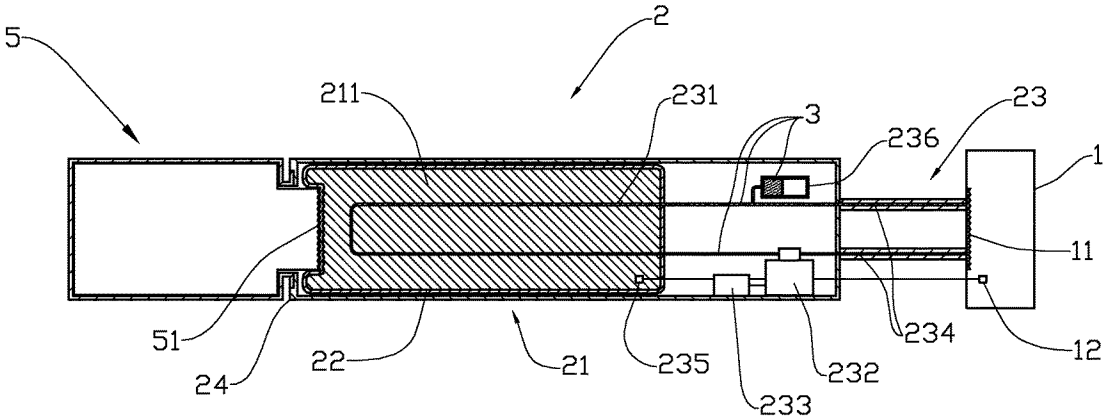
1
11
12
23
236
234
232
3
233
231
235
2
21
211
22
24
51
5

DOWNHOLE LOGGING TOOL COOLING DEVICE

CROSS-REFERENCE TO RELATED APPLICATIONS

The present application is a 35 U.S.C. §§ 371 national phase conversion of PCT/NO2013/050022, filed Feb. 7, 2013, which claims priority to Norwegian Patent Application Nos. 20120129 and 20130156, filed Feb. 8, 2012 and Jan. 31, 2013, respectively, the contents of which are incorporated herein by reference. The PCT International Application was published in the English language.

BACKGROUND OF THE INVENTION

The invention concerns a downhole tool cooling device wherein a downhole tool is thermally coupled to a rechargeable cold source comprising a solid cold source body being contained in an insulated cooling medium vessel, and wherein the downhole tool is thermally coupled to the cold source by means of a cooling circuit comprising a first heat exchanger arranged at the downhole tool and in a fluid communicating manner being interconnected with a second heat exchanger arranged in the solid cold source body. Furthermore it concerns a method for cooling a downhole tool, and finally the invention concerns use of a solid cold source body contained in an insulated cooling medium vessel as a cold source for a cooling circuit being thermally coupled to a downhole tool being in the need of cooling during downhole operations.

Oil-well logging tools are by definition built to work in a hostile environment. This means that they need to operate at temperatures and pressures, which are significantly higher than those encountered in everyday usage of electronic equipment. Methods describing cooling of electronic components using Peltier elements have been disclosed in the past. Thermoelectric systems generally use Peltier elements, which are capable of moving thermal energy from one side of their envelope to the opposite side with application of an electrical voltage, creating quite high differences in temperature from one side to the other. Such systems are most commonly found in PCs, for example, to assist in the cooling of the central processing unit. The issue with Peltier elements is that their effective efficiency i.e. the amount of energy consumed compared to the amount of energy moved between the hot and cold surface can fall to very low values, such as less than 2% efficiency, when high differences in temperatures across the elements are required. In hot environments, such as exploration or production boreholes for oil and gas, the environmental temperatures can be in excess of 200° C. Electronics generally have a maximum operating temperature of 70-80° C. (for processors), and even automotive electronics can only function below 150° C. In such cases the required temperature difference which a system has to be capable of achieving to ensure that a device remains below 70° C. can be as high as 130° C. In this respect, at such high temperatures, if a Peltier element was employed to transport 10 watts of thermal energy away from a device by depositing said thermal energy into a hot environment of 175° C., for example, then at 2% efficiency, the Peltier element would consume 500 W of power in the process. In reality, such elements are usually rated for power consumption levels much lower than this, so the effective efficiency losses results in the inability of the system to maintain the cold-end cold.

In the example of borehole exploration drilling and oil and gas production systems, where devices such as instruments, mechanical or electronic items need to be maintained at a temperature much lower than that of the surrounding environment, such a power consumption would be impractical, as most power conveyance systems (such as wireline cables) can only carry a maximum of 1000 W, for which the majority of the power is dissipated in the primary systems, and not in supporting systems such as cooling.

The refrigeration method usually consists of a single or series of linked compression and evaporator cycles, as best described by a standard domestic refrigerator. Although, such systems do not function well when the hot-end radiator is already hot as such systems rely on convection to remove the excess heat from the radiating element. In addition, the temperature difference required for maintaining an operating temperature for electronics in a hot environment, as depicted above, requires multiple stages of refrigerators each with a different working fluid. In this respect, standard Freon-type systems do not boast the operating temperature required for such applications, an additional issue is that refrigeration systems require compressors and a multitude of moving parts, with the consequent reduction in reliability and robustness.

In recent years, attempts have been made to use free piston Stirling engines in hot environments, such as exploration and production wells, with limited success. The systems rely upon the active driving of the compression piston only. The displacement piston is connected only to a spring for displacement and resonance. Such systems need to be tuned so that the entire assembly reciprocates in resonance, whereby the displacement piston oscillates in harmonic motion out of phase with the harmonic motion of compression piston. The compression piston may be oscillated by use of a linear actuator or copper-coil and magnet combination, or by mechanical arm connection to a rotating disk, as illustrated in the original Stirling engine. In this respect, such beta-cycle free-piston Stirling engines can be highly efficient as only one piston is being driven, with an effective reduction in mechanical or electrical load as a result.

However, the phase relationship between the compression piston and the displacer piston is a function of the resonant frequency of the system which is a function of the masses of the pistons, the compression ratios, the pressure of the working fluid and the temperature of the working fluid. As the temperature of the working fluid increases as a result of a hot external environment, the pressure of the working fluid changes too, the result is a change in the resonant frequency of the system which alters the phase relationship between the pistons. In practice, the trapezium form of the Carnot cycle decreases and diminishes as the phase angle of the two pistons decreases from the typical 60 degrees down to 0 degrees. In this respect a free-piston Stirling engine becomes less and less efficient as the working fluid changes temperature and pressure, in addition the cycle collapses and the phase relationship descends to a phase angle of zero degrees meaning that there is no bias between the hot and cold sides of the system. The free-piston Stirling engine requires that the hot-side is actively cooled in some way.

In the case of an application of the Stirling cooler technology within a borehole for exploration or production, the environment can be very hot (up to 175° C.). Cooling has to be done via convection to the borehole liquid(s), preferable while the downhole tool is moving. The Stirling cooler has to be laid out to function in these hot ambient conditions. It will transfer thermal energy at an overall efficiency of about 25% and as such allow the cooling of a sold source, which in turn is inside a Dewar flask.

US 2006/0144619 A1 describes an apparatus for circulation of a coolant through a thermal conduit thermally coupled to a chassis heat exchange element including a plurality of receiving sections thermally coupled to a corresponding plurality of electronic devices. The temperature of one or more of the plurality of electronic devices may be sensed, and the flow rate of the coolant adjusted in accordance with the sensed temperature. The thermal conduit may be placed in fluid communication with a heat exchanger, perhaps immersed in a material, such as a phase-change material, including a eutectic phase-change material, a solid, a liquid, or a gas. A variety of mechanisms can be used to cool the apparatus when it is brought to the surface after operation in the borehole. In some cases, it is desirable to remove and replace the apparatus entirely. In others, a charging pump is used. The charging pump may be used to circulate the coolant in the conduit of the apparatus. For rapid turnaround, the coolant may be chilled while it is circulated. This can occur either by replacing the coolant with new coolant, or simply chilling the existing coolant and circulating it within the conduit until the temperature of the circulated coolant remains at a selected temperature.

US2004/00264543 A1 describes a temperature management system for managing the temperature of a discrete, thermal component. The temperature management system comprises a heat exchanger in thermal contact with the thermal component. The system also comprises a fluid transfer device that circulates a coolant fluid through a thermal conduit system. As the coolant flows through the heat exchanger, it absorbs heat from the component. Upon exiting the heat exchanger, the heated coolant flows to the heat sink where the heat sink absorbs heat from the coolant fluid, the heat sink comprising a phase change material. Phase change material is designed to take advantage of the heat absorbed during the phase change at certain temperature ranges. For example, the phase change material may be a eutectic material having a component composition designed to achieve a desired melting point for the material. The desired melting point takes advantage of latent heat of fusion to absorb energy. When the material changes its physical state, it absorbs energy without a change in the temperature of the material. Therefore, additional heat will only change the phase of the material, not its temperature. To take advantage of the latent heat of fusion, the eutectic material would have a melting point below the boiling point of water and below the desired maintenance temperature of the thermal component.

SUMMARY OF THE INVENTION

The invention has for its object to remedy or reduce at least one of the drawbacks of the prior art, or at least provide a useful alternative to the prior art.

The object is achieved through features which are specified in the description below and in the claims that follow.

The wording "downhole tool" is used for any object that is provided in a borehole with the purpose of being used when executing an action (apparatus) or obtaining information (sensor).

A cooling device is thermally coupled to a downhole tool, hereafter also called cooled object, requiring operating temperature considerable below ambient temperature present in bore holes in most oil and/or gas producing structures, e.g. logging tools utilizing X-ray backscatter imaging to obtain images from mechanisms and components in the well, to maintain a favourable tool temperature, the cooling device being arranged with a cold source thermally connected to the cooled object. The cold source is acting as receiver of the thermal energy being removed from the cooled object. i.e. the downhole tool. The cold source is arranged in the form of a solid metal body. For the downhole purpose the metal body is preferably cylindrical.

The cold source is connectable with a refrigeration system arranged for charging the cold source, i.e. cooling the solid metal of the cold source.

The cold source is contained in an insulated cooling medium vessel, e.g. a Dewar flask. The cold source comprises an integrated fluid flowline connected to a cooling circuit capable of circulating a cooling medium through the cold source, the integrated fluid flowline acting as a first heat exchanger transferring heat energy from the cooling medium to the metal of the cold source, and through a second heat exchanger on the cooled object in order to remove heat energy from said cooled object, i.e. the tool in question, transferring thermal energy to the cold source. Preferably the portions of the cooling circuit connecting the cold source and the second heat exchanger are insulated to avoid undesirable thermal energy transfer from the environment to the cooling medium.

The cold source vessel comprises refrigeration system docking means to allow the refrigeration system to be disconnected from the cold source. The purpose of disconnecting the refrigeration system is to exchange the refrigeration system for another one in order to adapt the total cooling capacity to the requirements of the operation to be performed. Furthermore the initial charging may take place on the surface using a stationary, high capacity refrigerator prior to reconnecting the refrigeration system and the cold source.

A cold source vessel/refrigeration system interface comprises heat exchange means to achieve an efficient thermal coupling during the charging of the cold source.

The refrigeration system may be arranged as liquid nitrogen circulation system, a Stirling machine or a regular refrigerator using a single or series of linked compression and evaporator cycles. For long-term downhole operations a Stirling machine is preferred.

The refrigeration system may be arranged to operate during interruptions in the operations of the cooled object, i.e. the tool in question. Thereby the requirements with regards to power transfer from a surface installation are brought down.

The cooling medium is preferably a fluid.

The cooling circuit comprises a circulation pump connected to a pump controller.

The cooling circuit and the cooling medium vessel may comprise one or more cooling medium expanding means, e.g. accumulator(s), piston(s) or bellow(s) to adapt the available medium volumes to the current cooling media volume changes due to change in cooling media temperatures.

Temperature sensors are preferably installed in the cold source and close to the cooled object. The sensors are used to monitor the change in temperature of the tool and that of the cold source as the assembly descends into a hot well. During operation of the cooling device, the cooling medium will transfer heat to the cold source, the cold source being warmed up despite the charging performed by the refrigeration system. Thus there will be a gradual decrease in cooling capability for the same amount of liquid flow. To compensate, the pump speed, i.e. the cooling medium flow speed may be altered to still achieve sufficient cooling. A downhole microprocessor with the dedicated software logic may use the temperature sensor inputs to optimize the cooling medium flow and adjust the pump speed accordingly.

Continued operation of a cooled object like a downhole X-ray camera will require the successful implementation of some key elements:

- The extended use of the cold source will greatly depend on overall excellent insulation of the entire equipment involved in the heat exchange.
- The cooling media to be used need to have very good heat transfer characteristics, have little change in viscosity with temperature and preferably a large spread between freezing and boiling points.
- The software and tool logic used to operate the cooling system needs to run a continued feedback loop and resource optimization to ensure maximum operational time. Input from various temperature sensors is used to monitor ambient borehole temperature, cooled object temperature as well as cold source temperature. The cooled object is cooled accordingly through varying the pump speed. Interruptions during the operation of the tool may be used to run the refrigeration system to re-cool the cold source, especially if the refrigeration system is a Stirling machine. Remaining cooling capacity is forward modelled and reported to the engineer on surface via signal transfer means known per se.
- When temperature limits are exceeded the system first issues warnings and in case no action from the engineer is taken, is capable of performing an emergency shutdown.

In a first aspect the invention concerns particularly a downhole tool cooling device, wherein a downhole tool is thermally coupled to a rechargeable cold source comprising a solid cold source body being contained in an insulated cooling medium vessel, and wherein the downhole tool is thermally coupled to the cold source by means of a cooling circuit comprising a first heat exchanger arranged at the downhole tool and in a fluid communicating manner being interconnected with a second heat exchanger arranged in the solid cold source body, wherein a refrigeration system is thermally coupled to the cold source during a downhole operation of the cooling device.

The cooling circuit may comprise a circulation pump arranged with a pump controller generating pump control signals at least based on input from temperature sensors located at the downhole tool and in the cold source.

The cooling circuit may comprise a cooling medium expanding means capable of containing a variable portion of a cooling medium included in the cooling circuit.

The cooling medium vessel may comprise docking means for the refrigeration system, a vessel/refrigeration system interface forming the thermal coupling between the cold source and the refrigeration system.

The refrigeration system may be picked from the group comprising a liquid nitrogen circulation system, a Stirling machine, and a refrigerator using a single or series of linked compression and evaporation cycles.

In a second aspect, the invention concerns particularly a method for cooling a downhole tool, wherein the method comprises the steps of:

- charging a cold source by cooling a first cooling medium contained in an insulated cooling medium vessel;
- circulating a first cooling medium in a cooling circuit interconnecting a first and a second heat exchanger;
- transferring thermal energy from the downhole tool to the first cooling medium via the first heat exchanger; and
- transferring thermal energy form the cooling medium to the cold source via the second heat exchanger, wherein the method comprises the further step of:
- charging the cold source by means of a refrigeration system during the downhole operation of the downhole tool.

The charging of the cold source may be performed by means of a refrigeration system prior to the downhole operation of the downhole tool.

In a third aspect, the invention concerns particularly use of a pre-cooled solid cold source body contained in an insulated cooling medium vessel as a cold source for a cooling circuit being thermally coupled to a downhole tool being in the need of cooling during downhole operations.

BRIEF DESCRIPTION OF THE DRAWING

In what follows is described an example of a preferred embodiment which is visualized in the accompanying drawing, in which:

FIG. 1 depicts an axial section of a cooled object connected to a cold source thermally coupled to a refrigeration system according to the invention.

DESCRIPTION OF PREFERRED EMBODIMENTS

A cooled object 1, also called downhole tool, is thermally connected with a cooling device 2 by means of a cooling circuit 23 interconnecting a first heat exchanger 11 arranged in the cooled object 1 and a second heat exchanger 231 arranged in an insulated cooling medium vessel 22.

The cooling device 2 comprises a cold source 21 in the form of a solid body 211 contained in the cooling medium vessel 22, the vessel 22 preferably being in the form of a Dewar flask or the like. The solid body 211 is made of a material exhibiting thermal capacity and thermal conductivity satisfactory for the purpose of absorbing heat at a reasonable speed, preferably a metal like copper. The solid body cooling medium 211 is arranged with a cooling medium conduit portion arranged as the second heat exchanger 231.

The cooling circuit 23 includes a circulation pump 232 performing circulation of a cooling medium 3 in said circuit 23 and the thereto connected first and second heat exchangers 11, 231. Cooling medium conduits 234 constituting portions of the cooling circuit 23 and connecting the heat exchangers 11, 231 are insulated to avoid undesirable heating of the second cooling medium 3 while flowing between the cooling device 2 and the cooled object 1.

The cooling circuit 23 also includes a cooling circuit expanding means 236 allowing the cooling medium 3 expand into said expanding means 236 during temperature increase caused by the operation of the cooled object 1.

The circulation pump 232 is in a signal communicating way connected to a pump controller 233. The pump controller 233 includes several temperature sensors 12, 235 for the monitoring of the temperature of the cooled object 1 and the cold source 21, at least. The pump controller 233 is arranged for adjustment of the speed of the pump 232 to be adapted to the need of cooling capacity as the temperature of the cold source 21 gradually increases during the downhole operations.

The cooling device 2 includes docking means 24 for the connection of a refrigeration system 5 comprising vessel/refrigeration system interface 51 acting as a thermal coupling for transfer of thermal energy between the cold source 21 and the refrigeration system 5 when there is a need of charging the cooling device 2. The refrigeration system 5 might be releasably connected to the cooling device 2 to allow the refrigeration system 5 to be released if there is a need of exchanging the refrigeration system 5 with another one (not shown) in order to adapt the charging capacity to the requirements of the operation to be performed, or to connect the cold source to a stationary refrigerator (not shown) on the surface prior to lowering the cooled object 1 and the cooling device 2 into the borehole. The refrigeration system 5 might be in the form of a liquid nitrogen circulation system, a Stirling machine or a regular refrigerator using a single or series of linked compression and evaporator cycles; however, any type of refrigeration system 5 offering adequate capacity is relevant. A Stirling machine is preferred if the downhole power supply capacity is not allowing simultaneous operation of the cooled object 1 and the refrigeration system 5. The refrigeration system 5 in the form of a Stirling machine can be arranged to operate during interruptions in the operations of the cooled object 1. Thereby the requirements with regards to power transfer from a surface installation are brought down.

While preparing the tool and cooling device 1, 2 assembly for downhole operation, the cooling device 2 is (re)charged on the surface, i.e. the cooling medium 211 contained in the cooling medium vessel 22 is cooled by means of the refrigeration system 5, possibly by a stationary, high capacity refrigerator (not shown) located on a surface installation (not shown) connected to the cooling device 2 by means of the docking means 24. Thereafter the tool and cooling device 1, 2 assembly with the refrigeration system 5 connected, are lowered into the borehole.

During the operation of the downhole tool 1 in the need of cooling, the cooling medium 3 is circulated in the cooling circuit 23 by means of the circulation pump 232 being controlled by the pump controller 233 based on the monitoring of the temperatures of the tool 1 and the output temperature of said cooling medium 3 at the second heat exchanger 231 in the cold source 21. Thermal energy is thus transferred from the downhole tool 1 to the cold source 21 by means of the interaction of the heat exchangers 11, 231, the cooling medium 3 and the pump 232. If a stage of insufficient cooling capacity occurs due to the temperature of cold source 21 being too high, additional charging on spot can be performed by operating the refrigeration system 5, or in the case of refrigeration system 5 not being capable of maintaining prescribed temperature of the cold source 2, data acquisition of the downhole tool is temporarily halted and consequently in doing so there is no cooling requirement. The Sterling cooler can be run to re-charge the cold source to a sufficient level that then allows again commencement of operation.

The invention claimed is:

1. An assembly, comprising:

a downhole tool and a re-coolable, cold source that includes a coolable, solid source body and an insulating cooling medium vessel in which the solid source body resides, the downhole tool being outside the insulating cooling medium vessel and thermally coupled to the solid source body by means of a cooling circuit comprising at least one cooling medium conduit extending out of the insulating cooling medium vessel, a first heat exchanger arranged at the downhole tool and in a fluid communicating manner being interconnected with a second heat exchanger arranged in the solid source body via the at least one cooling medium conduit, wherein the solid source body is at a temperature lower than the temperature of the downhole tool when the assembly is deployed for a downhole operation; and wherein the solid source body is configured to be thermally coupled to a refrigeration system during a downhole operation of the downhole tool.

2. The assembly according to claim 1, wherein the cooling circuit comprises a circulation pump arranged with a pump controller generating pump control signals at least based on input from temperature sensors located at the downhole tool and in the cold source.

3. The assembly according to claim 1, wherein the cooling circuit comprises a cooling medium expanding means capable of containing a variable portion of a cooling medium included in the cooling circuit.

4. The assembly according to claim 1, wherein the insulating cooling medium vessel comprises docking means for the refrigeration system, a vessel/refrigeration system interface forming the thermal coupling between the cold source and the refrigeration system.

5. A assembly according to claim 1, wherein the refrigeration system is picked from the group comprising a liquid nitrogen circulation system, a Stirling machine, and a refrigerator using a single or series of linked compression and evaporator cycles.

6. A method for cooling a downhole tool in an assembly, the method comprising the steps of:

charging a cold source by cooling a solid source body of the cold source contained in an insulating cooling medium vessel to a temperature below a temperature of the downhole tool prior to deploying the assembly, and locating the downhole tool outside the insulating cooling medium vessel;

circulating a cooling medium in a cooling circuit having at least one cooling medium conduit interconnecting a first heat exchanger at the downhole tool and a second heat exchanger located at the solid source body;

transferring thermal energy from the downhole tool to the cooling medium via the first heat exchanger;

transferring thermal energy from the cooling medium to the cold source via the second heat exchanger, wherein the method comprises the further step of:

charging the cold source by means of a refrigeration system during the downhole operation of the downhole tool.

7. The method of claim 6, wherein the cooling medium conduit extends out of the insulating cooling medium vessel.

8. A method for cooling a downhole tool in an assembly, the method comprising the steps of:

charging a cold source by cooling a solid source body of the cold source contained in an insulating cooling medium vessel to a temperature below a temperature of the downhole tool prior to deploying the assembly, and locating the downhole tool outside the insulating cooling medium vessel;

circulating a cooling medium in a cooling circuit having at least one cooling medium conduit interconnecting a first heat exchanger at the downhole tool and a second heat exchanger;

transferring thermal energy from the downhole tool to the cooling medium via the first heat exchanger located at the solid cold source body;

transferring thermal energy from the cooling medium to the cold source via the second heat exchanger, wherein the method comprises the further step of:

charging the cold source by means of a refrigeration system prior to and during the downhole operation of the downhole tool.

9. The method of claim 8, wherein the cooling medium conduit extends out of the insulating cooling medium vessel.

10. A method of cooling a downhole tool in an assembly, the method comprising using a pre-cooled solid source body that is cooled by a refrigeration system to a temperature below a temperature of the downhole tool, and is contained in an insulating cooling medium vessel as a source for a cooling circuit and thermally coupling the cooling circuit to the downhole tool to cool the downhole tool before starting and during downhole operations, wherein the downhole tool is located outside the insulating cooling medium vessel.

11. A method of claim 10, wherein the cold source is charged by the refrigeration system during the downhole operation of the downhole tool.

12. A method of claim 11, wherein the cold source is charged by the refrigeration system prior to the downhole operation of the downhole tool.

13. A method of claim 10, wherein the cold source is charged by the refrigeration system prior to the downhole operation of the downhole tool.

14. The method of claim 10, wherein the solid source body is thermally coupled to the downhole tool by a cooling medium conduit that extends out of the insulating cooling medium vessel.

* * * * *